US007007530B2

(12) United States Patent
Koyama et al.

(10) Patent No.: US 7,007,530 B2
(45) Date of Patent: Mar. 7, 2006

(54) BENDING METHOD AND BENDING DEVICE

(75) Inventors: Junichi Koyama, Kanagawa (JP); Kazunari Imai, Kanagawa (JP); Hitoshi Omata, Kanagawa (JP); Osamu Hayama, Kanagawa (JP); Hidekatsu Ikeda, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 289 days.

(21) Appl. No.: 10/169,747

(22) PCT Filed: Jan. 17, 2001

(86) PCT No.: PCT/JP01/00266

§ 371 (c)(1),
(2), (4) Date: Jul. 17, 2002

(87) PCT Pub. No.: WO01/53020

PCT Pub. Date: Jul. 26, 2001

(65) Prior Publication Data

US 2003/0000269 A1 Jan. 2, 2003

(30) Foreign Application Priority Data

Jan. 17, 2000 (JP) ..... 2000-008298
Jan. 17, 2000 (JP) ..... 2000-008301

(51) Int. Cl.
*B21D 5/02* (2006.01)

(52) U.S. Cl. ..... 72/31.1; 72/31.11; 72/389.4; 72/389.5; 72/702; 100/257; 364/476

(58) Field of Classification Search ..... 72/389.4, 72/389.5, 389.6, 31.1, 31.11, 11, 20.1, 12, 72/702, 19.1; 100/257; 29/753; 364/476

See application file for complete search history.

(56) References Cited

U.S. PATENT DOCUMENTS

| | | | | |
|---|---|---|---|---|
| 4,802,357 A * | 2/1989 | Jones | ..... | 72/389.6 |
| 4,831,862 A * | 5/1989 | Ohashi et al. | ..... | 72/389.6 |
| 5,497,647 A * | 3/1996 | Nagakura | ..... | 72/389.3 |
| 5,761,940 A | 6/1998 | Moore, Jr. et al. | | |
| 5,987,958 A | 11/1999 | Moore, Jr. et al. | | |
| 6,189,364 B1 * | 2/2001 | Takada | ..... | 72/702 |

FOREIGN PATENT DOCUMENTS

| | | |
|---|---|---|
| JP | 1-48087 | 10/1989 |
| JP | 4-2359 | 1/1992 |
| JP | 6-16994 | 3/1994 |
| JP | 7-246427 | 9/1995 |

* cited by examiner

*Primary Examiner*—David B. Jones

(74) *Attorney, Agent, or Firm*—Greenblum & Bernstein, P.L.C.

(57) ABSTRACT

In bending a workpiece, a position of the workpiece relatively pressed down by a punch is directly detected by a plurality of position detectors provided in a V-groove of a die, and a bending speed calculation section obtains a bending speed from a change in this position. If bending speeds at position of the respective position detectors differ, a uniform speed arithmetic operation section calculates a bending speed to make the bending speeds at the positions of all of the position detectors, and a driving shaft instruction section controls driving shafts to bend the workpiece at the uniform bending speed.

8 Claims, 18 Drawing Sheets

FIG. 12A
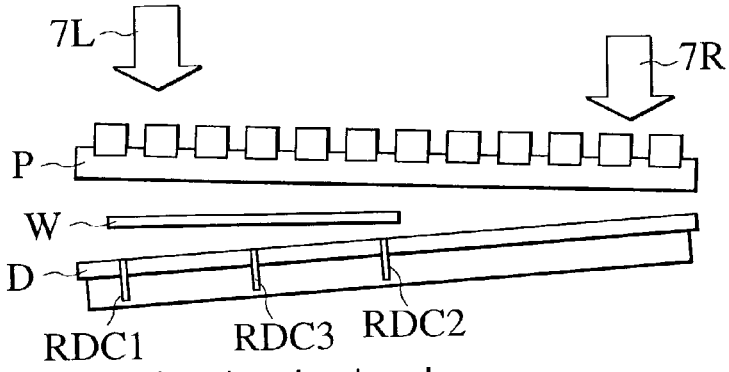
FIG. 12B
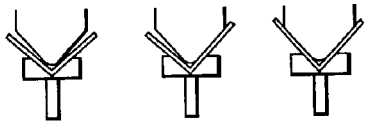
FIG. 12D
FIG. 12C
FIG. 13A
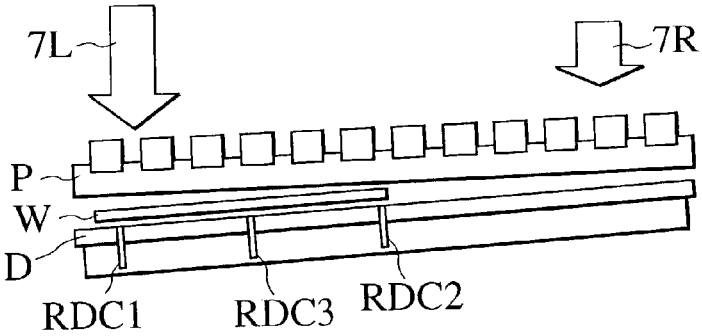
FIG. 13B
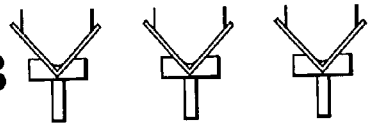
FIG. 13D
FIG. 13C FIG. 14A
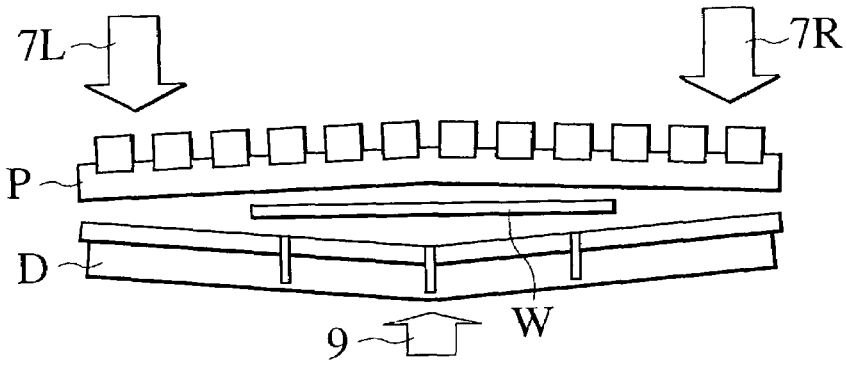
FIG. 14B
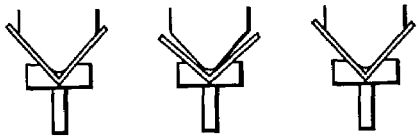
FIG. 14D
FIG. 14C
FIG. 15A
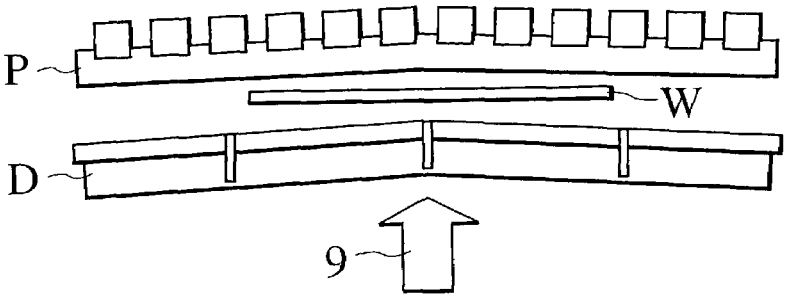
FIG. 15B
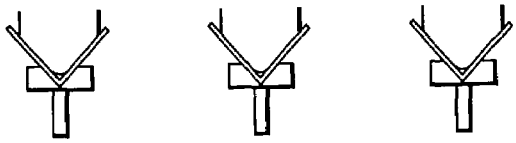
FIG. 15D
FIG. 15C

BENDING METHOD AND BENDING DEVICE

TECHNICAL FIELD

The present invention relates to a bending method and a bending device for bending a workpiece by relatively making a punch approach and separate to and from a die using at least two left and right driving shafts. More specifically, the present invention relates to a bending method and a bending device for clamping a workpiece by the workpiece clamper of a robot provided on the front side of a bending machine which bends the workpiece in cooperation with a punch and a die and for positioning the workpiece to a predetermined position between the punch and the die.

BACKGROUND ART OF THE INVENTION

There is conventionally known that a press brake, which is a bending machine, ascends and descends a punch attached to an upper table relatively to a die attached to a lower table and thereby bends a workpiece in cooperation with the punch and the die. According to the conventional art, however, as shown in FIG. 1, if a workpiece W is set at a position offset in the longitudinal direction of a punch P and a die D, the workpiece W is to be so-called offset-bent. Due to this, a D-value (relative distance between the punch and the die) becomes non-uniform and a bending progress portion and a bending delay portion occur. Therefore, the conventional art has a disadvantage in that the passage angle of the workpiece W does not coincide with a target angle.

According to the conventional art, however, as shown in FIG. 1, if a workpiece W is set at a position offset in the longitudinal direction of a punch P and a die D, the workpiece W is to be so-called offset-bent. Due to this, a D-value (relative distance between the punch and the die) becomes non-uniform and a bending progress portion and a bending delay portion occur. Therefore, the conventional art has a disadvantage in that the passage angle of the workpiece W does not coincide with a target angle.

Furthermore, as shown in FIGS. 2A and 2B, if a part of the workpiece W is bent cooperatively by the punch P and the die D, an unbent portion is disadvantageously bent by the mutual influence of the punch P and the die D and the bending angle of a part of a bent portion disadvantageously decreases.

Meanwhile, as shown in FIG. 3, if the workpiece W is to be bent cooperatively by the punch P and the die D, the workpiece W is bent using a robot so as to follow up the spring of the workpiece W while clamping the workpiece by the workpiece clamper 101 of the robot or opening the workpiece clamper 101.

In this case, following the stroke position of the punch P, the position of the workpiece W when the workpiece W springs is subjected to a circular interpolation about of the shoulder section 103 of the die D and the follow-up coordinate of the workpiece clamper 101 of the robot is thereby calculated.

According to such conventional art, however, since the spring position of the workpiece is arithmetically operated based on the position of the die, the accurate workpiece spring position cannot be disadvantageously obtained. Further, since the conventional art cannot accurately deal with the bending speed and accurately follow up the bending speed in the end, "the buckling of the workpiece" and the like disadvantageously occur.

Furthermore, if bending is executed in a state in which pressure which horizontally acts on the workpiece is not uniform, whether offset bending or center bending, the right, center and left of the workpiece have different bending speeds. Due to this, even if a passage angle is eventually obtained, the workpiece is not always bent at a uniform insertion angle during the bending. Accordingly, if the robot or the like follows up bending, it is required to change the follow-up speed according to the clamp positions of the workpiece clamper 105, 107 and 109 as shown in FIG. 4, thereby disadvantageously making the operation quite laborious.

In view of the above-stated situations, the present invention has been achieved while paying attention to the conventional technical disadvantages stated above. It is, therefore, an object of the present invention to provide a bending method and a bending device capable of improving a bending passage angle by correcting a bending speed at a position in the longitudinal direction of a punch and a die.

It is another object of the present invention to provide a bending method and a bending device capable of accurately following up the spring of a workpiece using a robot.

DISCLOSURE OF THE INVENTION

To attain the above-stated objects, a bending method according to the first aspect of the invention comprises the steps of: making a punch relatively approach and separate to and from a die by at least two left and right driving shafts; directly detecting vertical movement of a workpiece following bending by a plurality of position detection means provided in a longitudinal direction of the die along an interior of a V-groove of the die; obtaining bending speeds of the workpiece at positions of the respective position detection means from the vertical movement, and controlling the driving shafts so as to make the bending speeds at the positions of the respective position detection means equal to one another; and making the die relatively approach and separate to and from the die to thereby bend the workpiece.

As described above, in the bending method of the invention, the position of the workpiece relatively pressed down by the punch is directly detected by a plurality of position detection means provided in the V-groove of the die, bending speeds are obtained from changes in the positions, if the bending speeds at the positions of the respective position bending means differ, the driving shafts are controlled to make the bending speeds at the positions of all the position detection means uniform. Therefore, it is possible to improve workpiece passage accuracy in the longitudinal direction of the punch and the die and to bend the workpiece with high accuracy.

In a bending method according to the second aspect of the invention is based on the bending method according to the first aspect, the driving shafts are left and right vertical cylinders and a crowning cylinder provided in a central portion of a lower table.

Accordingly, the punch is vertically moved at least by the left and right vertical cylinders and the crowning cylinder provided at the center of the lower table. It is, therefore, possible adjust the bending speeds at the positions of the respective position detection means.

In a bending method according to the third aspect of the invention based on the bending method according to the first or second aspect, if the workpiece bending speeds detected by the left and right position detection means differ from each other, the left and right driving shafts are controlled to obtain an average bending speed of the bending speeds at the positions of the left and right position detection means.

Accordingly, if the bending speeds at the positions of the left and right position detection means differ, the left and right driving shafts are controlled so that the bending speeds at the positions of the left and right position detection means become the average speed of the left and right bending speeds.

In a bending method according to the fourth aspect of the invention based on the bending method according to the second aspect, if the workpiece bending speeds detected by the left and right position detection means are equal but the workpiece bending speed detected by the position detection means provided in the central portion is different, then the crowning cylinder is controlled to change pressure of the crowning cylinder so that the workpiece bending speed detected by the position detection means provided in the central portion becomes equal to the bending speeds at the positions of the left and right position detection means.

Accordingly, if the workpiece bending speeds detected by the left and right position detection means are equal but the workpiece bending speed detected by the position detection means provided in the central portion is different, the bending speed at the position of the position detection means other than the left and right position detection means can be made equal to the bending speeds at the positions of the left and right position detection means.

A bending device according to the fifth aspect of the invention comprises: a punch and a die made relatively approach and separate to and from each other by at least two left and right driving shafts so as to bend a workpiece; a plurality of position detection means provided in a longitudinal direction of the die along an interior of a V-groove of the die; a bending speed calculation section calculating workpiece bending speeds from changes in positions of the workpiece detected by the respective position detection means; a uniform speed arithmetic operation section calculating a uniform speed from the bending speeds at positions of the respective position detection means; and a driving shaft instruction section controlling the respective driving shafts so that the bending speeds at the positions of the respective position detection means become the uniform speed calculated by the uniform speed arithmetic operation section.

Accordingly, in bending the workpiece, the position of the workpiece relatively pressed down by the punch is directly detected by a plurality of position detection means provided in the V-groove of the die, bending speeds are obtained from changes in the positions, if the bending speeds at the positions of the respective position bending means differ, the uniform speed arithmetic operation section calculates a bending speed so as to make the bending speeds at the positions of all the position detection means uniform and the driving shaft instruction section controls the driving shafts to bend the workpiece at the uniform bending speed. Therefore, it is possible to improve workpiece passage accuracy in the longitudinal direction of the punch and the die and to bend the workpiece with high accuracy.

In a bending device according to sixth aspect of the invention based on the bending device according to the fifth aspect, the driving shafts comprise left and right vertical cylinders and a crowning cylinder provided at a central position of a lower table having the die attached to an upper end portion of the lower table.

Accordingly, the punch is vertically moved at least by the left and right vertical cylinders and the crowning cylinder provided at the center of the lower table. It is, therefore, possible adjust the bending speeds at the positions of the respective position detection means.

In the bending device according to seventh aspect of the invention based on the bending device according to the fifth or sixth aspect, if the workpiece bending speeds at the positions of the left and right position detection means detected by the bending speed calculation section differ from each other, the uniform speed arithmetic operation section calculates the uniform speed which is an average speed of the bending speeds at the positions of the left and right position detection means, whereby the driving shaft instruction section controls the left and right driving shafts to obtain the uniform speed.

Accordingly, if the bending speeds at the positions of the left and right position detection means calculated by the bending speed arithmetic operation section differ, the driving shaft instruction section controls the left and right driving shafts so that the bending speeds at the positions of the left and right position detection means become the average speed of the left and right bending speeds calculated by the uniform speed arithmetic operation section.

The bending device according to the eighth aspect of the invention based on the bending device according to the fifth or sixth aspect, is characterized in that if the workpiece bending speeds at the positions of the left and right position detection means calculated by the bending speed calculation section are equal but the workpiece bending speed detected by the central position detection means differs, then the uniform speed arithmetic operation section obtains an average speed of the bending speeds at the positions of the left and right position detection means; and the driving shaft instruction section controls the crowning cylinder to change pressure of the crowning cylinder and to make the workpiece bending speed detected by the central position detection means equal to the average speed obtained by the uniform speed arithmetic operation section.

Accordingly, if the workpiece bending speeds at the positions of the left and right position detection means detected by the left and right position detection means are equal but the workpiece bending speed at the position of the central position detection means is different, the bending speed at the position of the position detection means other than the left and right position detection means can be made equal to the bending speeds at the positions of the left and right position detection means using the crowning cylinder provided at the center of the lower table.

A bending method according to the ninth aspect of the invention comprises the steps of: clamping a workpiece by a workpiece clamper of a robot provided on a front side of a bending machine bending the workpiece in cooperation with a punch and a die and operating, and positioning the workpiece to a predetermined position between the punch and the die; directly detecting a relative stroke value of the punch to the die using a vertically movable displacement gauge provided in the die and protruded from a V-groove of the die; calculating a workpiece follow-up locus and a workpiece follow-up speed of the workpiece clamper of the robot from the detected relative stroke of the punch; distributing an instruction to respective shaft driving means of the robot so as to move the workpiece damper along the workpiece follow-up locus at the calculated workpiece follow-up speed, and allowing the workpiece damper to follow up movement of the workpiece; and bending the workpiece positioned to the predetermined position between the punch and the die.

Accordingly, in bending the workpiece clamped by the workpiece clamper of the robot provided on the front side of the bending machine bending the workpiece and delivered between the punch and the die, the relative stroke of the punch is directly detected by the displacement gauge provided in the die to calculate the relative upper and lower positions and moving speed of the punch, and the workpiece follow-up locus and the workpiece follow-up speed of the workpiece damper are calculated by the positions and speed of this punch. In addition, an instruction is distributed to the respective shaft driving means of the robot so as to move the workpiece at the workpiece follow-up speed along the workpiece follow-up locus.

Further, it is possible to obtain the workpiece follow-up locus and follow-up speed with high accuracy based on the actual behavior of the workpiece. In addition, since the workpiece damper moves at the workpiece follow-up speed along the workpiece follow-up locus in accordance with the spring of the workpiece, it is possible to bend the workpiece with high accuracy.

A bending method according to the tenth aspect of the invention comprises the steps of: clamping a workpiece by a workpiece clamper of a robot provided on a front side of a bending machine bending the workpiece in cooperation with a punch and a die, and positioning the workpiece to a predetermined position between the punch and the die; creating a bending program and a robot operation program according to information from CAD; selecting a displacement gauge closest to the workpiece clamper of the robot operating based on workpiece supply attitude information from the bending program and the robot operation program, from among vertically movable displacement gauges provided in the die and protruded from a V-groove of the die; directly detecting a relative stroke value of the punch to the die using the selected displacement gauge; calculating a workpiece follow-up locus and a workpiece follow-up speed of the workpiece clamper of the robot from this detected relative stroke of the punch; distributing an instruction to respective shaft driving means of the robot so as to move the workpiece clamper along the workpiece follow-up locus at this calculated workpiece follow-up speed; allowing the workpiece clamper to follow up movement of the workpiece; and bending the workpiece by the punch and the die.

Accordingly, in bending the workpiece which is clamped by the workpiece clamper of the robot provided on the front side of the bending machine bending the workpiece based on the bending program created according to information from CAD and operating based on the robot operation program created based on this bending program, and which is delivered between the punch and the die, the relative stroke of the punch is directly detected by the displacement gauge closest to the workpiece damper among the displacement gauges provided in the die and the relative upper and lower positions and moving speed of the punch so as to move the workpiece damper clamping the workpiece in accordance with the spring following the bending of the workpiece. In addition, the instruction is distributed to the respective shaft driving means of the robot to control the means so as to move the workpiece damper at the workpiece follow-up speed along the workpiece follow-up locus.

Further, it is possible to obtain the workpiece follow-up locus and follow-up speed with high accuracy based on the actual behavior of the workpiece. In addition, since the workpiece clamper moves at the workpiece follow-up speed along the workpiece follow-up locus in accordance with the spring of the workpiece, it is possible to bend the workpiece with high accuracy.

The bending method according to the eleventh aspect of the invention, based on the bending method according to the ninth or tenth aspect, is characterized in that the respective shaft driving means of the robot include at least four axes of a Y axis in a longitudinal direction, a Z axis in a vertical direction, and an A axis and a B axis orthogonal to each other to rotate the workpiece clamper.

Accordingly, by moving the workpiece damper in the Y-axis direction which is a longitudinal direction, the Z-axis direction which is a vertical direction, and about the A-axis and the B-axis orthogonal to each other to rotate the workpiece clamper, the workpiece clamper can move at the workpiece follow-up speed along the calculated workpiece follow-up locus.

A bending device according to the twelfth aspect of the invention comprises: a punch and a die; a robot provided on a front side of a bending machine bending a workpiece in cooperation with the punch and the die and operating, the die including a workpiece damper and clamping the workpiece and positioning the workpiece to a predetermined position between the punch and the die so as to perform bending; a vertically movable displacement gauge provided in the die and protruded from a V-groove of the die so as to directly detect a relative stroke value of the punch to the die; stroke position and speed arithmetic operation means for calculating upper and lower positions and moving speed of the punch from the relative stroke of the punch detected by this displacement gauge; workpiece follow-up locus and speed arithmetic means for calculating a workpiece follow-up locus and a workpiece follow-up speed of the workpiece damper from the relative positions and speed of the punch calculated by the stroke position and speed arithmetic operation means based on a signal from the displacement gauge; and robot driving instruction information supply means for distributing an instruction to respective shaft driving means of the robot so as to move the workpiece damper along the workpiece follow-up locus at the workpiece follow-up speed calculated by this workpiece follow-up locus and speed arithmetic operation means.

Accordingly, in bending the workpiece which is delivered between the punch and the die by the workpiece damper of the robot provided on the front side of the bending machine, the stroke position and speed arithmetic operation means calculates the relative stroke and moving speed of the punch using the signal directly detected by the displacement gauge provided in the die and the workpiece follow-up locus and speed arithmetic operation means calculates the workpiece follow-up locus and workpiece follow-up speed of the workpiece damper so as to move the workpiece damper clamping the workpiece to follow up the spring of the workpiece following the bending. In addition, to move the workpiece damper at the workpiece follow-up speed along the workpiece follow-up locus obtained by the workpiece follow-up locus and speed arithmetic means, the robot driving instruction information supply means distributes an instruction to the respective driving means of the robot to control the means.

In other words, it is possible to obtain the workpiece follow-up locus and follow-up speed with high accuracy based on the actual behavior of the workpiece. In addition, since the workpiece damper moves at the workpiece follow-up speed along the workpiece follow-up locus in accordance with the spring of the workpiece in response to the instruction distributed to the respective shaft driving means of the robot, it is possible to bend the workpiece with high accuracy.

A bending device according to the thirteenth aspect of the invention comprises: a punch and a die; a robot provided on a front side of a bending machine bending a workpiece in cooperation with the punch and the die and operating, the die including a workpiece clamper and clamping the workpiece and positioning the workpiece to a predetermined position between the punch and the die so as to perform bending; bending and robot operation program arithmetic operation means for creating a bending program and a robot operation program in accordance with information from CAD; a plurality of vertically movable displacement gauges provided in the die and protruded from a V-groove of the die; displacement gauge selection means for selecting the displacement gauge closest to the workpiece clamper of the robot operating based on workpiece supply attitude information from the bending program and the robot operation program, from among the plurality of displacement gauges; workpiece follow-up locus and speed arithmetic operation means for calculating a workpiece follow-up locus and a workpiece follow-up speed of the workpiece clamper of the robot from a relative stroke value of the punch to the die detected by the displacement gauge selected by this displacement gauge selection means; and robot driving instruction information supply means for distributing an instruction to respective shaft driving means of the robot so as to move the workpiece clamper along the workpiece follow-up locus at this calculated workpiece follow-up speed.

Accordingly, in bending the workpiece which is clamped by the workpiece clamper of the robot provided on the front side of the bending machine bending the workpiece based on the bending program created by the bending and robot operation program arithmetic operation means according to information from CAD and operating based on the robot operation program created based on this bending program, and which is delivered between the punch and the die, the displacement gauge closest to the workpiece clamper is selected from among the displacement gauges provided in the die and the relative stroke of the punch is directly detected by this selected displacement gauge and the relative upper and lower positions and moving speed of the punch are calculated so as to move the workpiece damper clamping the workpiece in accordance with the spring following the bending of the workpiece. In addition, the instruction is distributed to the respective shaft driving means of the robot to control the means so as to move the workpiece clamper at the workpiece follow-up speed along the workpiece follow-up locus.

More specifically, it is possible to obtain the workpiece follow-up locus and follow-up speed with high accuracy based on the actual behavior of the workpiece. In addition, since the workpiece damper moves at the workpiece follow-up speed along the workpiece follow-up locus in accordance with the spring of the workpiece, it is possible to bend the workpiece with high accuracy.

In the bending device according to the fourteenth aspect of the invention based on the bending device according to the twelfth or thirteenth aspect, the respective shaft driving means are movable at least in directions of four axes of a Y-axis direction which is a longitudinal direction, a Z-axis direction which is a vertical direction, and directions about an A axis and a B axis which are two axes orthogonal to each other to rotate the workpiece clamper.

Accordingly, by moving the workpiece clamper in the Y-axis direction which is a longitudinal direction, the Z-axis direction which is a vertical direction, and about the A-axis and the B-axis orthogonal to each other to rotate the workpiece clamper, the workpiece clamper can move at the workpiece follow-up speed along the calculated workpiece follow-up locus.

BRIEF DESCRIPTION OF THE DRAWINGS

FIG. 12A is a front view showing an offset bending state, and FIGS. 12B, 12C and 12D are cross-sectional views showing the distance between the punch and the die.

FIG. 13A is a front view showing bending improved from offset bending, and FIGS. 13B, 13C and 13D are cross-sectional views showing the distance between the punch and the die.

FIG. 14A is a front view showing a state in which the central portions of the punch and the die are deflected, and FIGS. 14B, 14C and 14D are cross-sectional vies showing the distance between the punch and the die.

FIG. 15A is a front view showing bending improved from the bending shown in FIGS. 14A, 14B, 14C and 14D, and FIGS. 15B, 15C and 15D are cross-sectional vies showing the distance between the punch and the die.

BEST MODES FOR CARRYING OUT THE INVENTION

The embodiments of the present invention will be described hereinafter in detail with reference to the drawings.

Figure 5:
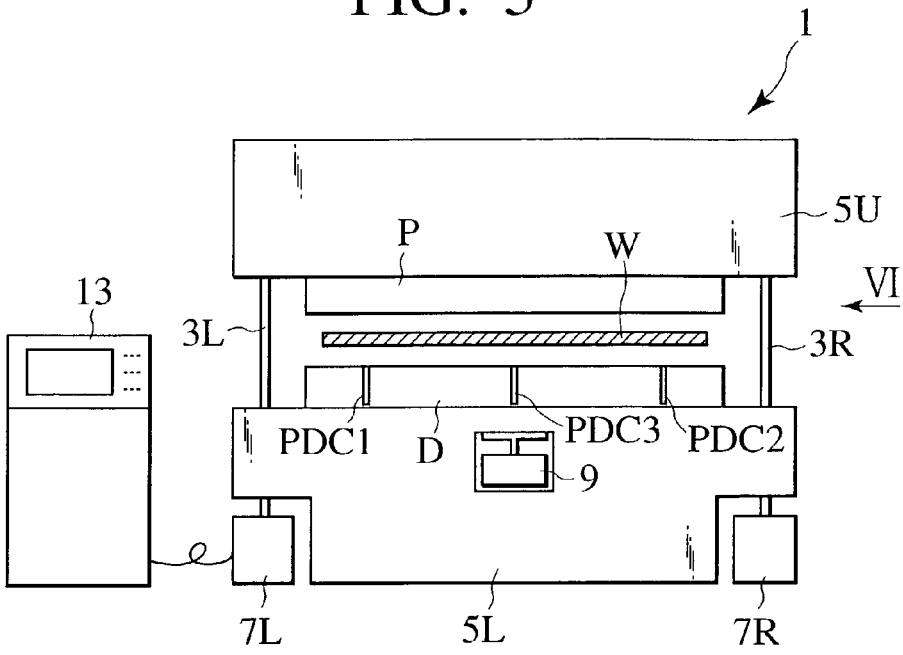
FIG. 5 is a front view showing a press brake which serves as a bending device according to the present invention.
Figure 6:
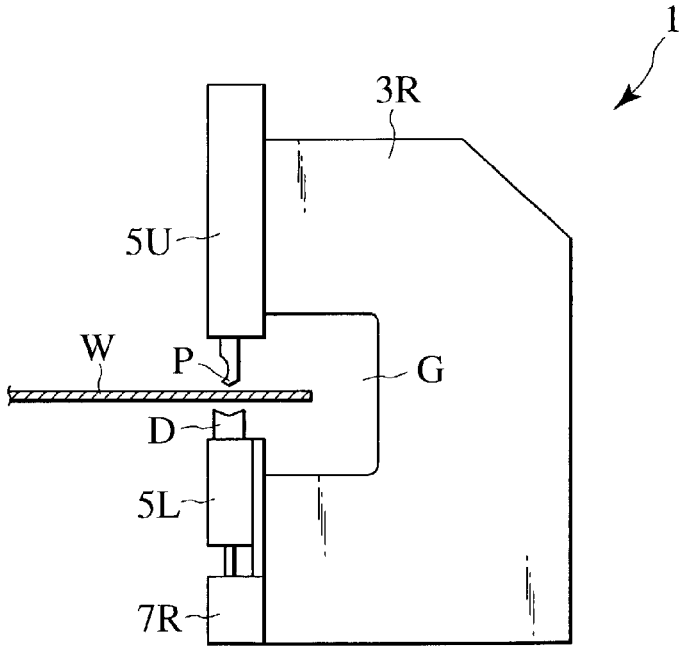
FIG. 6 is a side view seen from a direction VI of FIG. 5.

FIGS. 5 and 6 show a press brake 1 which serves as a bending device according to the present invention. Since the bending brake 1 itself is already well known, it will be described only schematically.

The press brake 1 has left and right side plates 3L and 3R each of which has a gap G in a central portion on the front surface of each of the side plates 3L and 3R and is generally C shaped, and an upper table 5U on the front surface of the upper portion of each of the side plates 3L and 3R. A punch P is attached to the lower end portion of this upper table 5U in an exchangeable manner.

On the other hand, a die D is attached to the front surface of the lower portion of each of the side plates 3L and 3R in an exchangeable manner, and the die D is vertically moved by vertical cylinders 7L and 7R which are provided on the front surfaces of the lower portions of the side plates 3L and 3R, respectively. In addition, a crowning cylinder 9 for lifting the longitudinal central portion of the die D is provided at the center of the lower table 5L.

It is noted that a V-groove 11 (see FIG. 8) for bending a workpiece W is provided on the upper portion of the die D in the longitudinal direction of the die D. Further, a controller 13 which controls the vertical cylinders 7L and 7R and the like is provided in the vicinity of the press brake 1.

With the above-stated configuration, the die D is ascended by the vertical cylinders 7L and 7R relatively to the workpiece W which is positioned between the punch P and the die D and the workpiece W is bent cooperatively by the punch P and the die D. At this moment, if the central portion of the die D is deflected, the central portion of the die is lifted by the crowning cylinder 9 so as to improve the passage of the workpiece W in the longitudinal direction of the die D.

Figure 7:
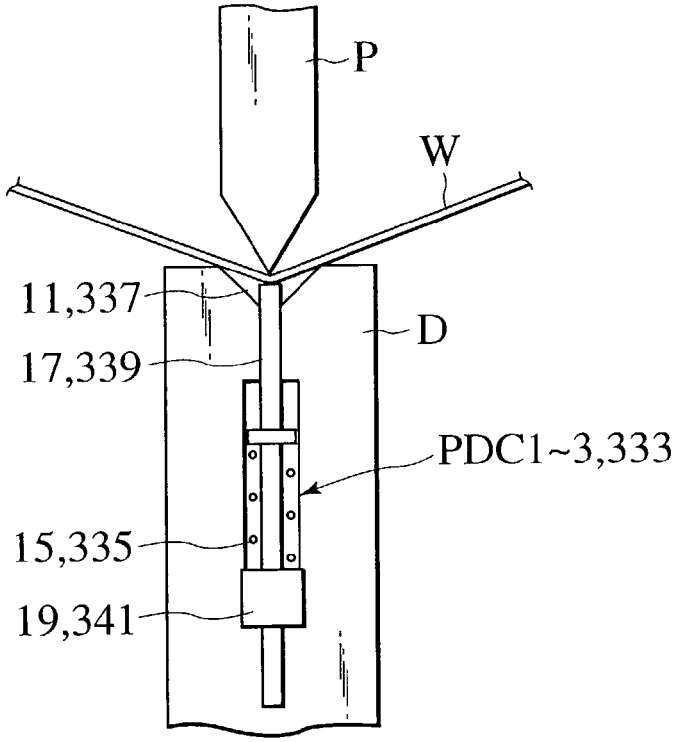
FIG. 7 is an enlarged cross-sectional view of a displacement gauge.

Referring to FIG. 7, a plurality of (three in this embodiment) displacement gauges RDC1, RDC2 and RDC3 which serve as position detection means are provided in the die D in the longitudinal direction of the die D. Each of these displacement gauges RDC1, RDC2 and RDC3 is provided with a detection pin 17 which is always urged upward by a spring 15 and which is vertically movably protruded from the V-groove 11 of the die D, and is provided with a linear scale 19 which detects the upper and lower positions of this detection pin 17.

Figure 8:
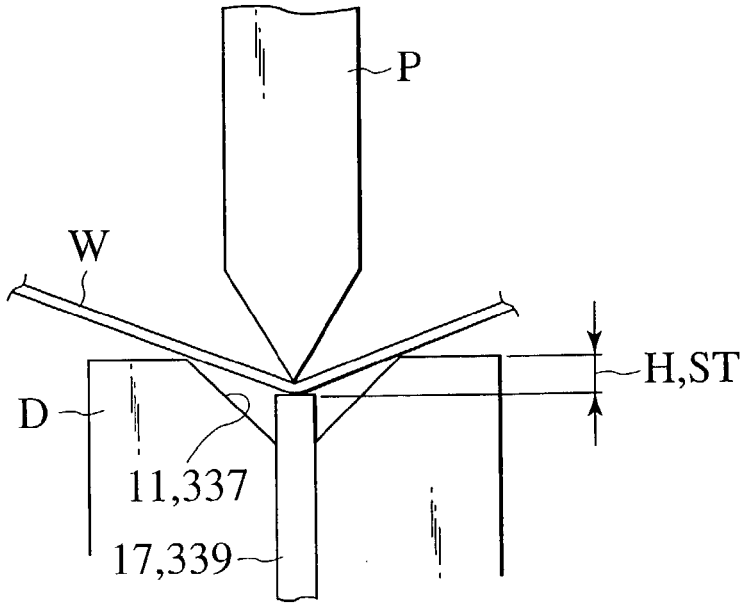
FIG. 8 is an explanatory view for a position detected by the displacement gauge or, more specifically, a cross-sectional view showing a state in which the relative stroke of the punch is detected by the displacement gauge.

Accordingly, the workpiece W, which is pressed and bent by the relative descent of the punch P by ascending the die D by the vertical cylinders 7L and 7R, presses the detection pin 17 relatively downward, the upper and lower positions of the detection pin 17 at this time are detected by the linear scale 19, and, as shown in FIG. 8, the distance between the upper end portion of the detection pin 17 and the upper surface of the die D is obtained as the position H of the lower surface of the workpiece W.

Figure 9:
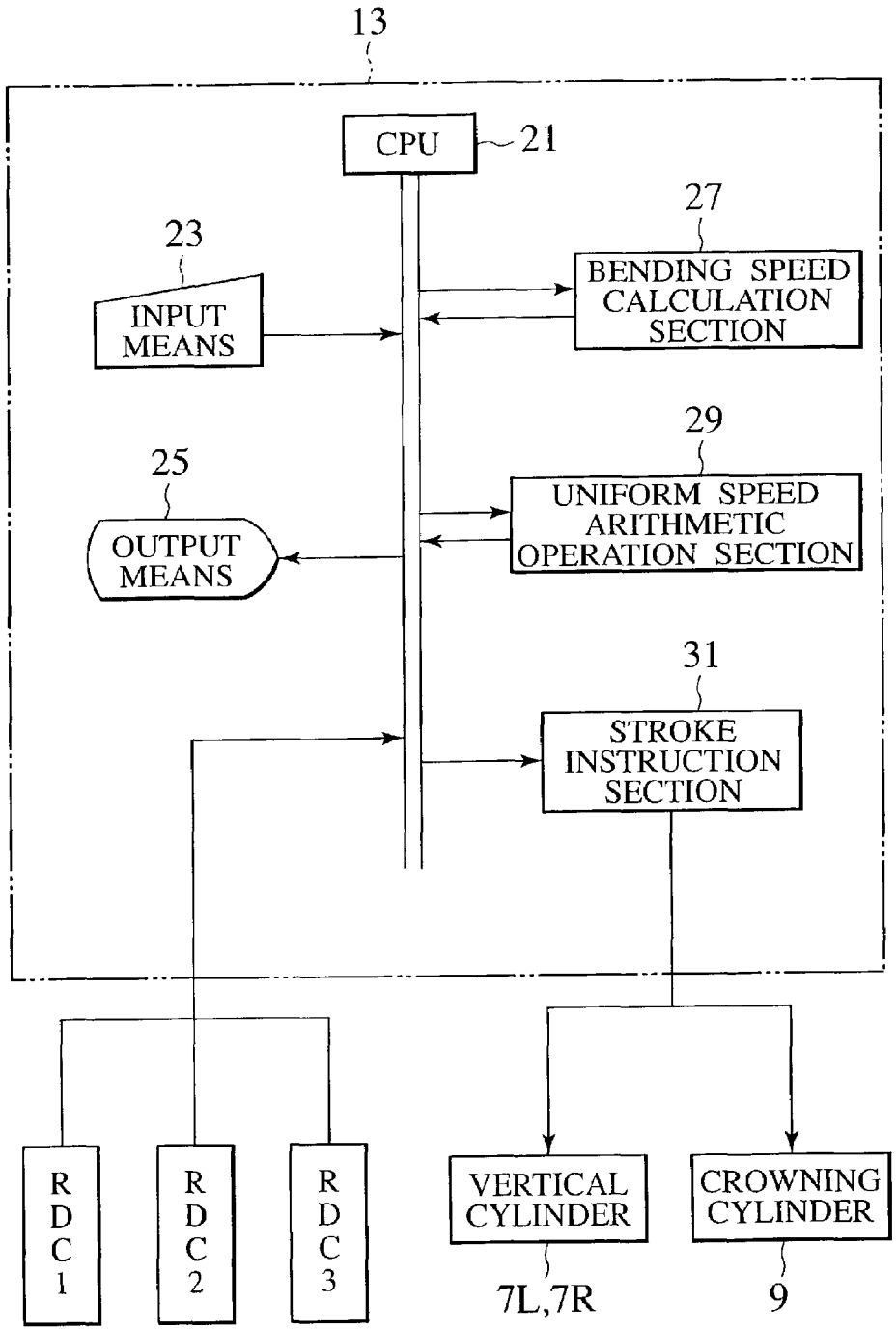
FIG. 9 is a block diagram showing the configuration of a controller.

Referring to FIG. 9, the controller 13 includes a CPU 21 or a central processing unit, to which an input means 23, such as a keyboard, for inputting various data and an output means 25, such as a CRT, for displaying the various data are connected. In addition, the displacement gauges RDC1, RDC2 and RDC3 are connected to the CPU 21 so that respective stroke detection signals can be transmitted to the CPU 21.

Furthermore, a bending speed calculation section 27 which calculates bending speeds at the positions of the displacement gauges RDC1, RDC2 and RDC3 from stroke detection signals from the displacement gauges RDC1, RDC2 and RDC3, respectively, a uniform speed arithmetic operation section 29 which calculates a speed for making the obtained bending speeds at the respective positions uniform, and a driving shaft instruction section 31 which controls the vertical cylinders 7L and 7R and the crowning cylinder 9 to thereby control the stroke of the die D so as to bend the workpiece W at a uniform bending speed, are connected to the CPU 21.

Figure 10:
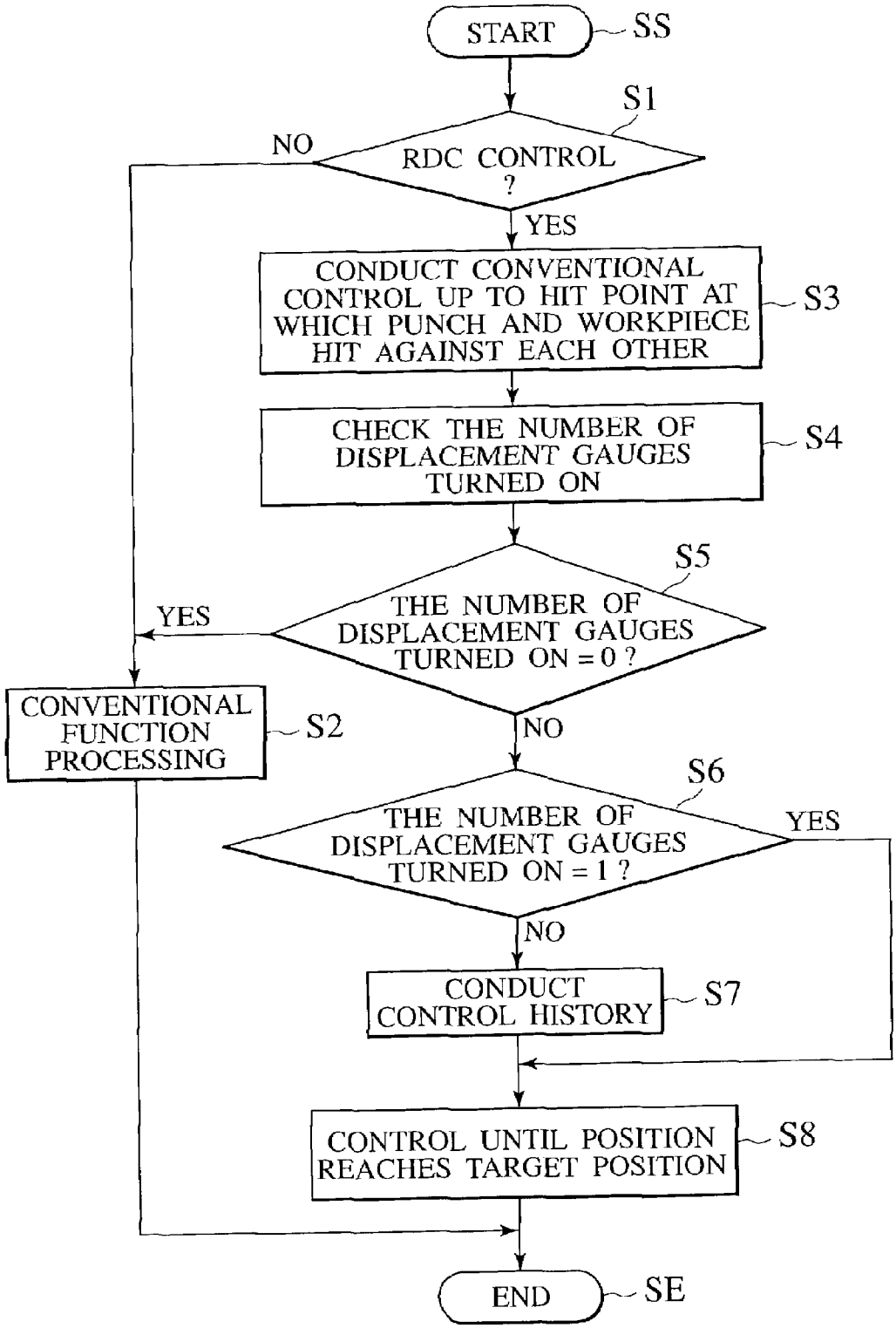
FIG. 10 is a flow chart showing a bending method according to the present invention.
Figure 11:
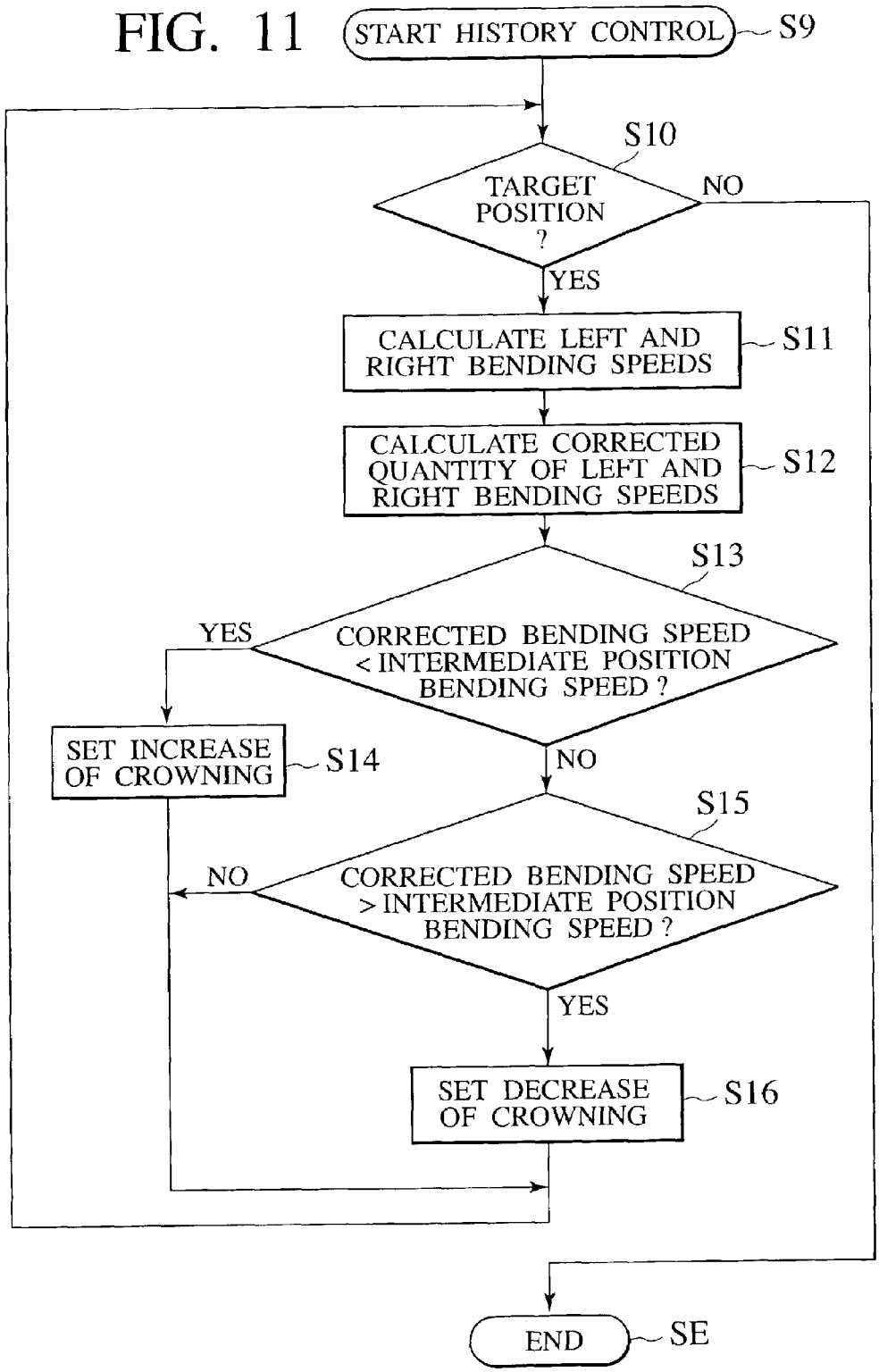
FIG. 11 is a flow chart showing history control steps.

Next, a bending method according to the present invention by employing history control will be described with reference to FIG. 10.

When bending starts (in a step SS), it is determined whether or not RDC (Real Depth Control) control is conducted (in a step S1). If the RDC control is not conducted, a conventional processing is carried out (in a step S2) and the bending is ended (in a step SE). The RDC control means herein directly measuring and controlling the distance from the upper surface of the die D to the lower surface of the workpiece W which is being bent.

If the RDC control is conducted, the vertical cylinders 7L and 7R are controlled to ascend the die D up to a hit point at which the punch P and the die hit against each other (in a step S3). The displacement gauges RDC1, RDC2 and RDC3 are turned on to check the number of displacement gauges which are turned on (in a step S4).

If the number of displacement gauges RDC1, RDC2 and RDC3 which are turned on is zero (in a step S5), a conventional processing is carried (in a step S2) and the bending is ended (in the step SE). If the number of displacement gauges RDC1, RDC2 and RDC3 which are turned on is not zero and the number thereof is not 1 (in a step S6), then history control to be described later is conducted (in a step S7), the positions of the displacement gauges are controlled to reach RDC target positions (in a step S8) and the bending is ended (in the step SE). If the number of the displacement gauges RDC1, RDC2 and RDC3 which are turned on is one in the step S6, then the history control is not conducted but the positions of the displacement gauges are controlled to reach the RDC target positions (in the step S8) and the bending is ended (in the step SE).

The history control will next be described with reference to FIGS. 11 to 18.

The basic concept of the history control will first be described. As shown in FIG. 12A, if offset bending is to be conducted, the workpiece W is offset to, for example, the left side. Therefore, load is, mainly applied to the left side of the workpiece W and the distance between blades widens as shown in FIG. 12B. As a result, the bending angle of the left side of the workpiece W is smaller than that at a position shown in FIG. 12C and the bending angle of the right side of the workpiece W shown in FIG. 12D becomes the greatest.

To correct the difference, as shown in FIG. 13A, the feed per stroke of the left vertical cylinder 7L is increased and that of the right vertical cylinder 7R is decreased as shown in FIG. 13A to thereby increase the left-side speed and decrease the right-side speed. As shown in FIGS. 13B, 13C and 13D, the bending angles at the respective positions are made equal to one another.

Furthermore, as shown in FIG. 14A, if the workpiece W is bent in the central portion thereof without offset, then the upper and lower tables 5U and 5L are deflected by a reactive force from the workpiece W during the bending and the bending angle of the central portion shown in FIG. 14C becomes smaller than those of the left and right sides shown in FIGS. 14B and 14D, respectively.

To correct the difference, the feed per stroke of the crowning cylinder 9 is increased to increase the feed per stroke in the central portion as shown in FIG. 15A, thereby making the bending angles equal to one another as shown in FIGS. 15B, 15C and 15D.

Referring back to FIG. 11, when history control starts based on the above-stated concept(in a step S9), it is determined whether or not the position of the workpiece W is the target position (in a step S10). If the position is the target position, the bending is ended (in a step SE). If not the target position, bending speeds at the left and right displacement gauges RDC1 and RDC2 are calculated by the bending speed calculation section 27 (in a step S11).

Figure 16:
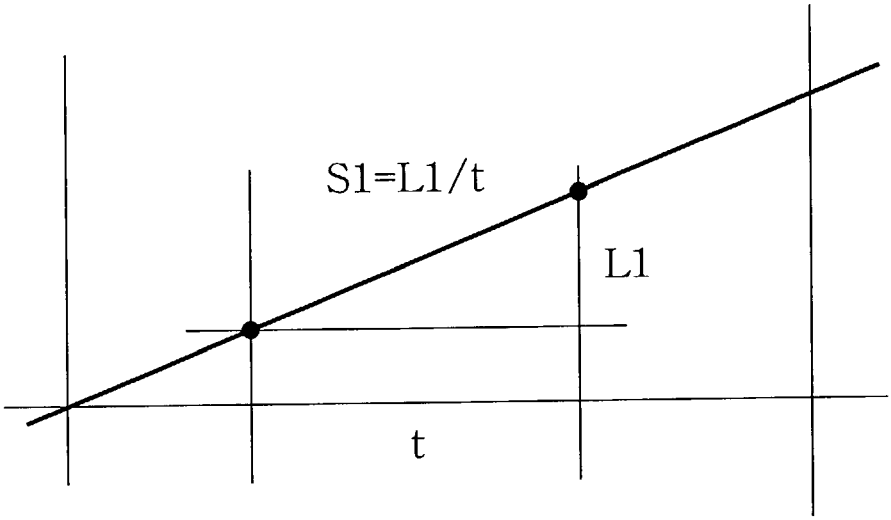
FIG. 16 is an explanatory view showing a principle for calculating a bending speed at the position of a displacement gauge RDC1.
Figure 17:
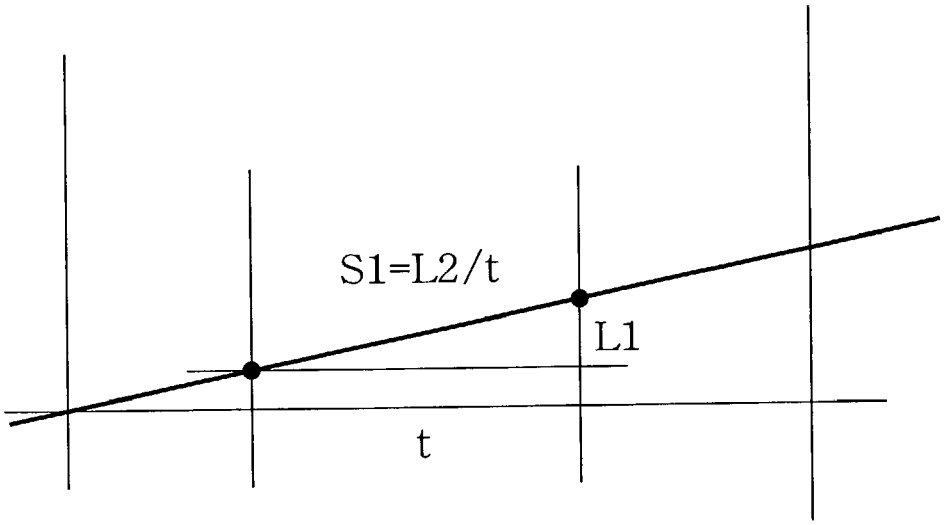
FIG. 17 is an explanatory view showing a principle for calculating a bending speed at the position of a displacement gauge RDC2.

Namely, as shown in FIG. 16, a bending speed S1 at the position of the RDC1 is obtained as S1=L1/t. In the expression, L1 represents a stroke quantity and t represents time. Likewise, as shown in FIG. 17, a bending speed S2 at the position of the RDC2 can be obtained as S2=L2/t.

Figure 18:
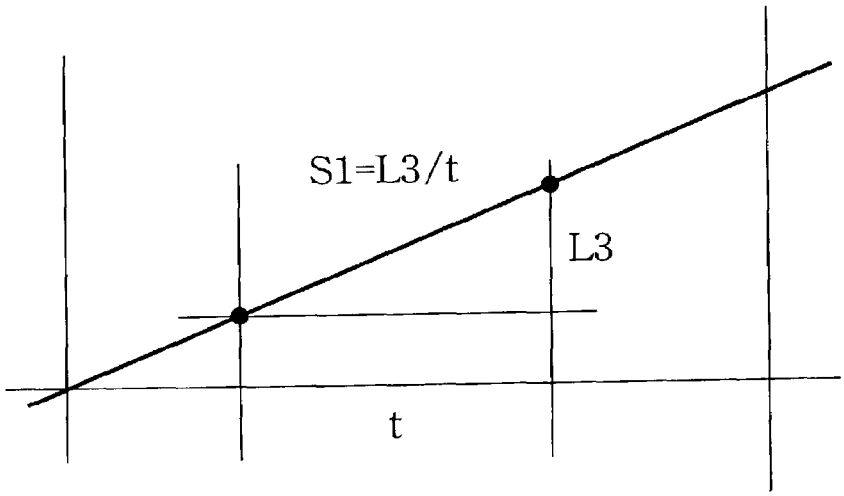
FIG. 18 is an explanatory view showing a principle for calculating a bending speed at the position of a displacement gauge RDC3.

Next, a corrected quantity delta S is calculated so that each of the axial speeds of the left and right vertical cylinders 7L and 7R becomes to equal to S=(S1+S2)/2 by the uniform speed arithmetic operation section 29 (in a step S12). As in the case of the positions of the left and right displacement gauges RDC1 and RDC2, a bending speed at the position of the central displacement gauge RDC3 is calculated by the bending speed calculation section 27 as shown in FIG. 18 and compared with the corrected bending speed stated above (in a step S13). If the corrected bending speed S is faster, the axial speed of the crowning cylinder 9 is increased so that the bending speed S3 at the position of the displacement gauge RDC3 becomes equal to the corrected bending speed S in response to the instruction of the stroke instruction section 31 (in a step S14) and the processing returns to the step S10 to repeat the step S10 and the following.

To increase the axial speed of the crowning cylinder, CC% is increased and crowning cylinder pressure is set according to (Crowning cylinder pressure)=(Pressures of left and right vertical cylinders 7L and 7R)×CC%.

On the other hand, if it is determined in the step S13 that the corrected bending speed S is not faster than the bending speed S3 at the position of the intermediate displacement gauge RDC3, then it is further determined whether or not the bending speed S3 at the position of the displacement gauge RDC3 is faster than the corrected bending speed S (in a step S15). If the bending speed S3 is faster than the corrected bending speed S, CC% is decreased and the axial speed of the crowning cylinder 9 is decreased so that the bending speed S3 becomes equal to the bending speed S, in response to the instruction of the stroke instruction section 31 (in a step S16). The processing returns to the step S10, the step S10 and the following are repeated. Further, if it is determined in the step S10 that the corrected bending speed S is not faster than the bending speed S3, the processing returns to the step S10 and the step S10 and the following are repeated.

As a result of the above, the bending speeds at the positions of the respective displacement gauges RDC1, RDC2 and RDC3 become uniform, so that it is possible to improve workpiece passage accuracy in the longitudinal direction of the punch P and the die D and to perform bending with high accuracy. It is noted that this invention is not limited to the embodiment of the invention but can be appropriately changed to make it possible to carry out the invention in another modes. In other words, in the above-stated embodiment, the press brake 1 for vertically moving the lower table 5L to which the die D is attached, using the vertical cylinders 7L and 7R has been described. However, a press brake for vertically moving the upper table 5U to which the punch P is attached is also available exactly in the same manner.

Figure 19:
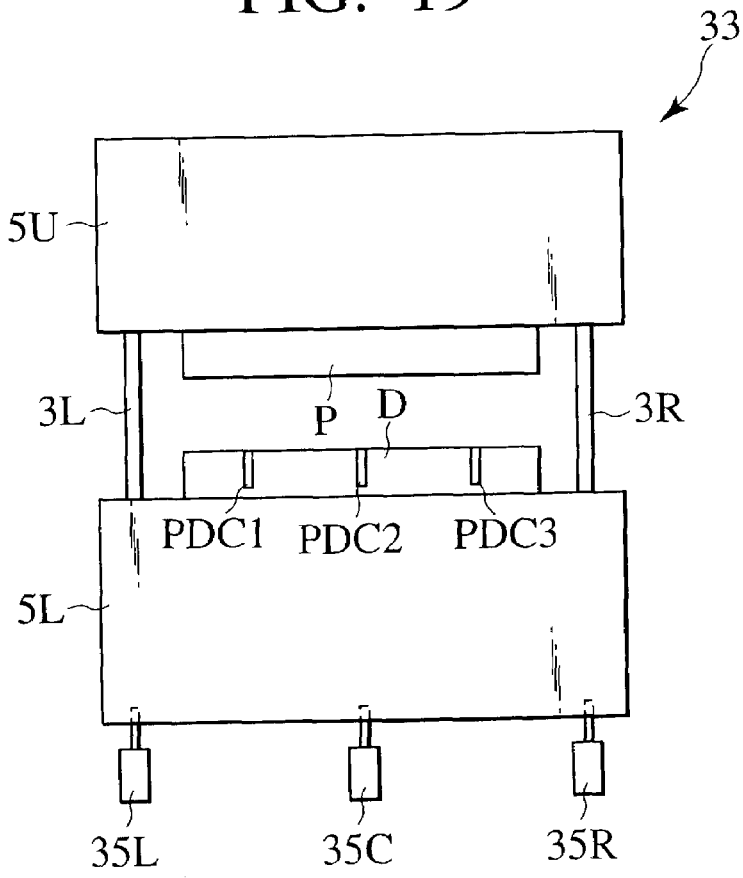
FIG. 19 is a front view showing another embodiment.
Figure 20:
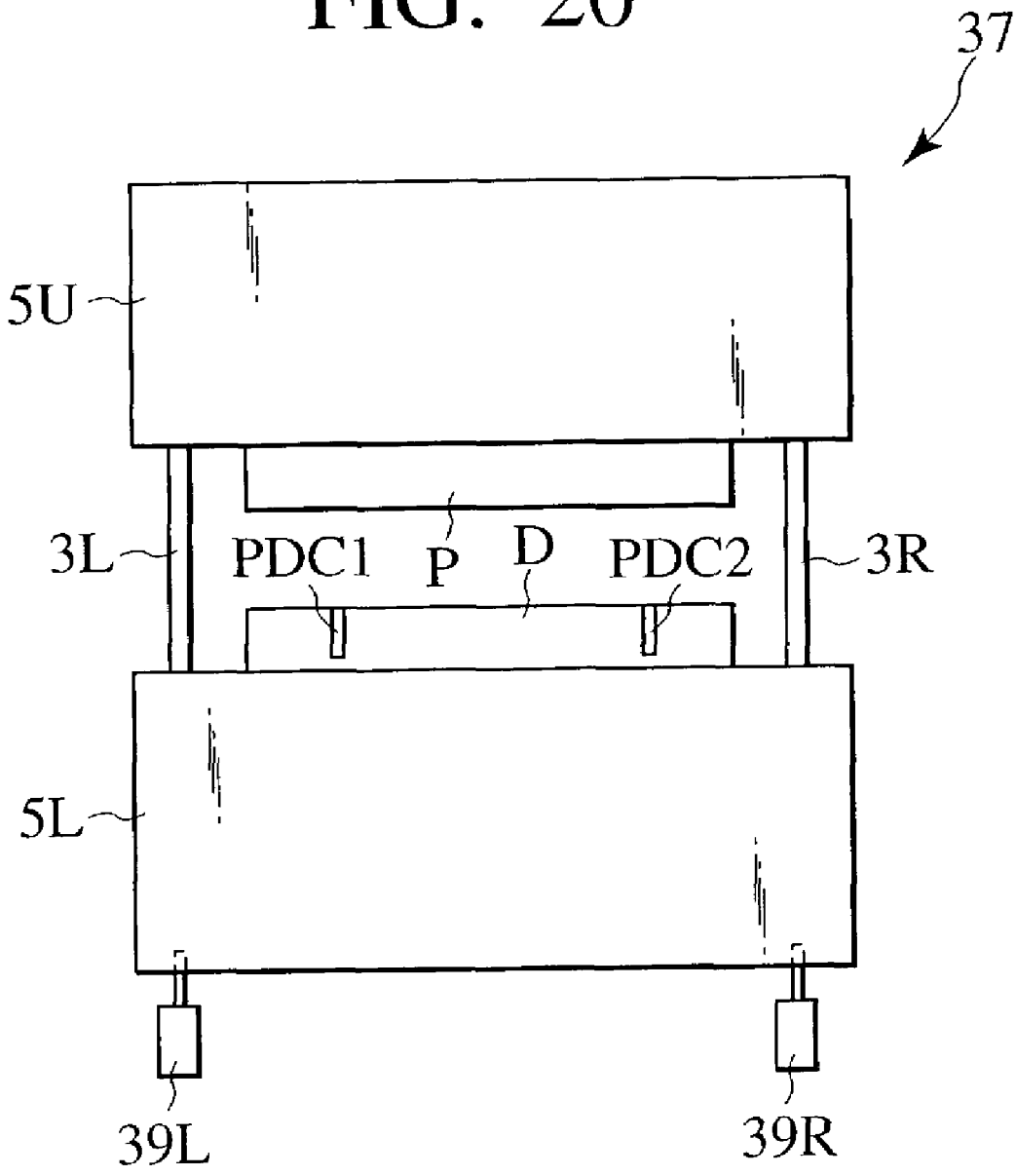
FIG. 20 is a front view showing yet another embodiment.

Furthermore, in the above embodiment, description has been given to a case of employing the left and right vertical cylinders 7L and 7R as the left and right driving shafts. Alternatively, a motor and a ball spring can be employed. Further, in the above embodiment, description has been given to a case of providing the crowning cylinder 9 at the center of the lower table 5L as a driving shaft other than the left and right driving shafts. Alternatively, as exemplified in a press brake 33 shown in FIG. 19, driving shafts 35L, 35R and 35C can be employed. Further, as exemplified in a press brake 37 shown in FIG. 20, two driving shafts 39L and 39R can be employed. In this case, however, two displacement gauges RDC1 and RDC2 are provided.

The second embodiment of the present invention will next be described with reference to the drawings.

Figure 21:
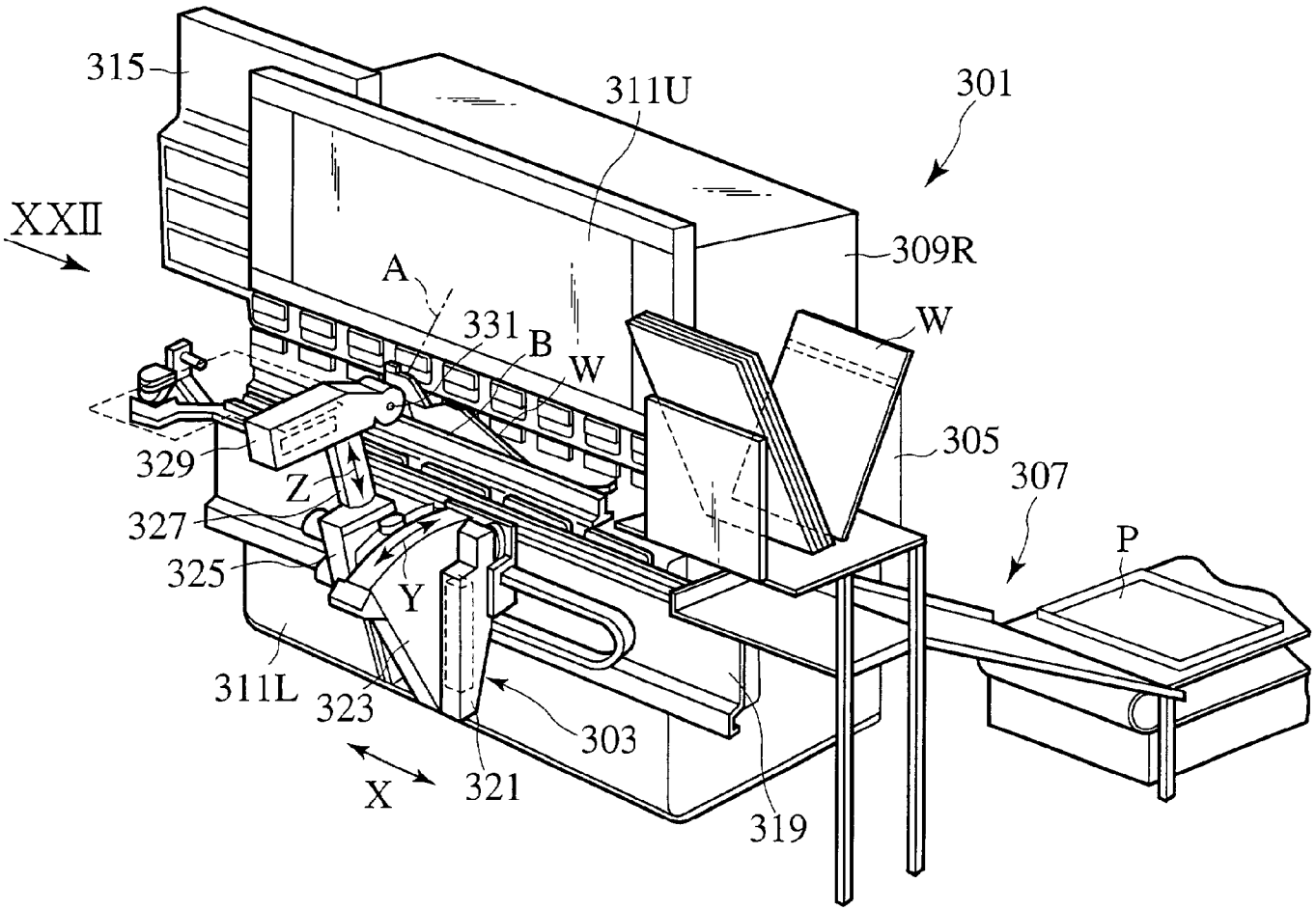
FIG. 21 is a perspective view showing a bending device according to the present invention.
Figure 22:
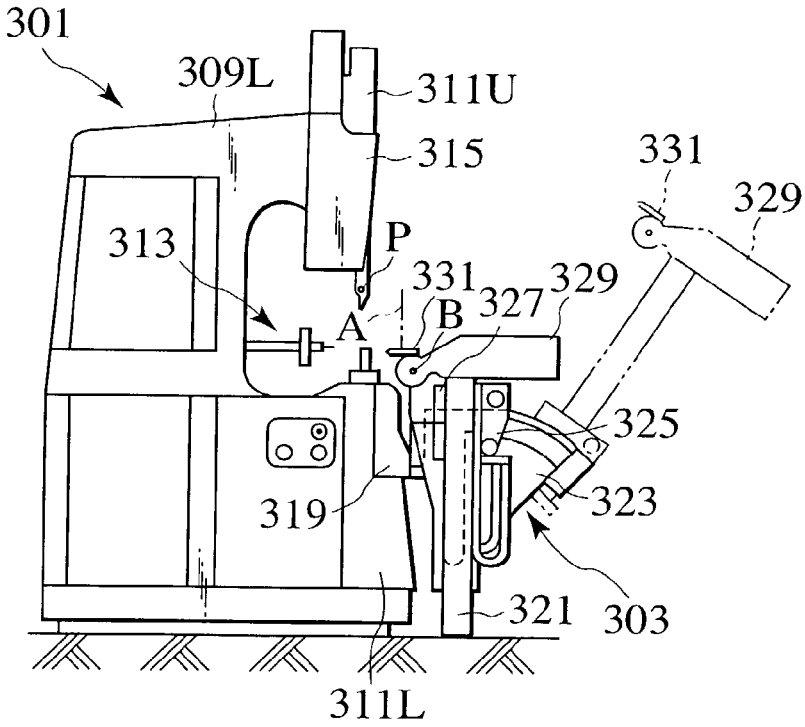
FIG. 22 is a side view seen from a direction XXII of FIG. 21.

Referring to FIGS. 21 and 22, a robot 303 for delivering a workpiece to a press brake 301 is provided on the front side of the press brake 301 which serves as a bending device. In addition, a magazine section 305 which contains the workpiece W and a transport unit 307 which transports a product P of the press brake 301 to the next process are provided on the side portion of the press brake 301. Since the configurations of the magazine section 305, the transport section 307 and the like are already well known, they will not be described herein in detail.

The press brake 301 includes left and right side plates 309L and 309R, an upper frame 311U is fixedly attached to the front surfaces of the upper portions of the side plates 309L and 309R and a lower frame 311L is provided on the front surfaces of the lower portions thereof to be able to be freely ascended and descended. A punch P is attached to the lower end portion of the upper frame 311U in an exchangeable manner and a die D is attached to the upper end portion of the lower frame 311L in an exchangeable manner.

Figure 1:
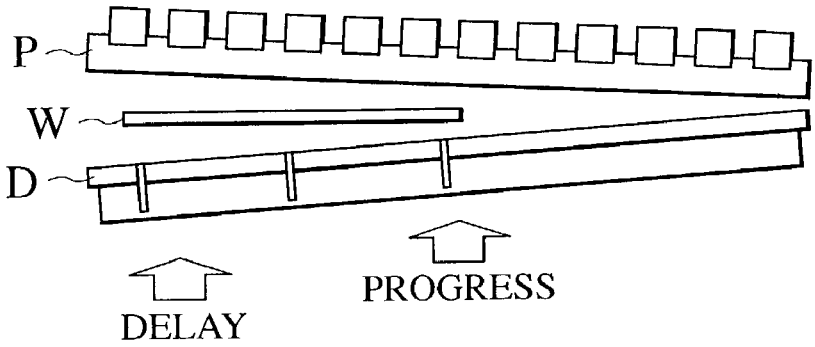
FIG. 1 is a front view showing an offset bending state.
Figure 2A:
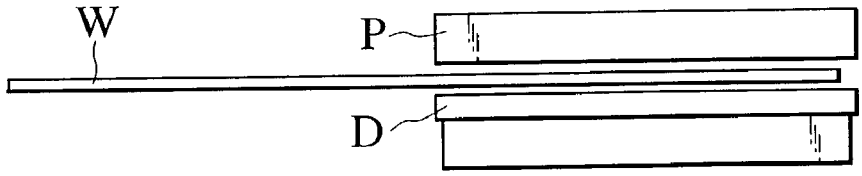
FIG. 2A is a front view showing a state in which a workpiece is longer than a punch and a die.
Figure 2B:
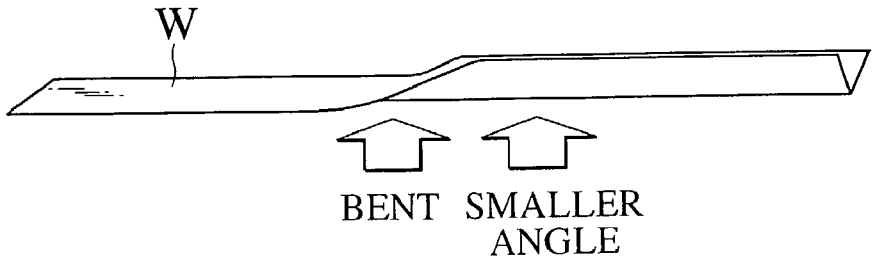
FIG. 2B is an explanatory view showing a product processing state.
Figure 3:
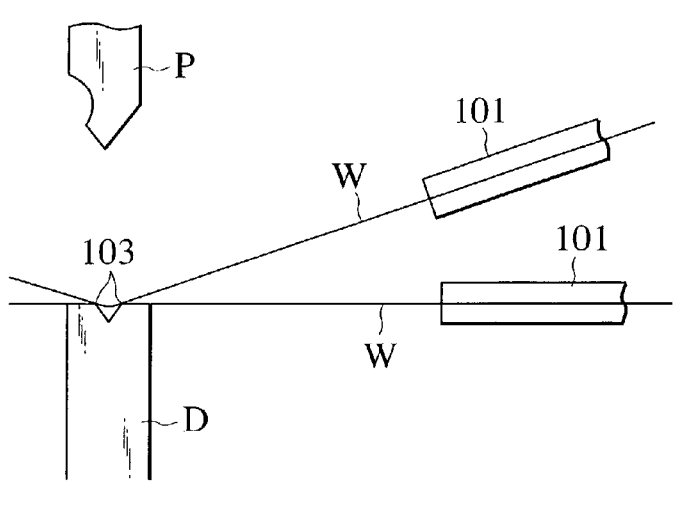
FIG. 3 is an explanatory view showing a workpiece clamper follow-up method in bending.
Figure 4:
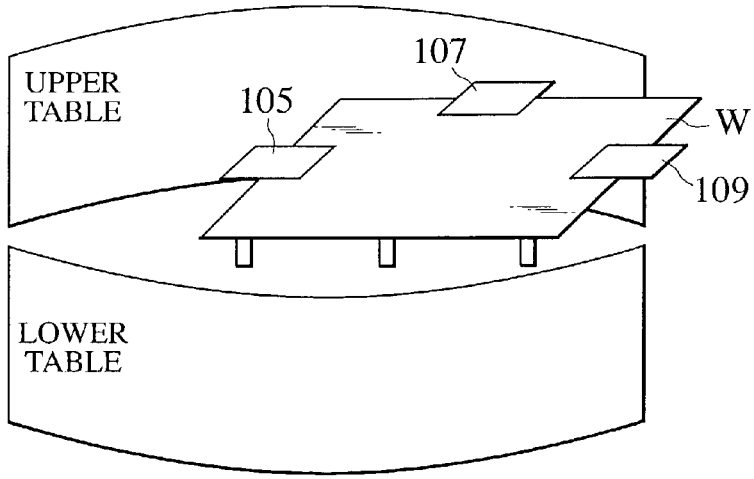
FIG. 4 is an explanatory view showing that a follow-up locus varies according to the clamp position of the workpiece clamper.

Further, a back gauge unit 313 which positions the workpiece W in a longitudinal direction (lateral direction; Y-axis direction in FIG. 2) is provided in the press brake 301 to be able to freely move and make positioning in the longitudinal direction. Further, a vertical moving means for ascending and descending the lower table 311L, and a controller 315 which controls the back gauge unit 313 and the like are provided in the press brake 301. This controller 315 is provided with a robot controller 317 (see FIG. 25) which controls the robot 303 to be described later.

With the above-stated configuration, by ascending and descending the lower table 311L, the workpiece W which is abutted on the back gauge unit 313 and positioned between the punch P and the die D by the robot 301, is bent cooperatively by the punch P and the die D.

On the other hand, a base plate 319 is provided integrally on the lower table 311L which can be freely ascended and descended. This base plate 319 is provided to extend in a lateral direction along the longitudinal direction of the die (vertical direction of the sheet; X-axis direction in FIG. 22). The robot 303 stated above is provided on the front surface of this base plate 319 to be able to freely move and make positioning in the X-axis direction.

Since the robot 303 is already well known, it will not be described in detail but described herein only schematically. In this robot 303, a first movable carriage 321 is provided movably in the X-axis direction along the base plate 319.

This first movable carriage 321 is provided with a sector section 323 having an upper side enlarged in the longitudinal direction (Y-axis direction) and the upper portion of this sector section 323 is provided with a second movable carriage 325 movable in the Y-axis direction.

The second movable carriage 325 is provided with an elevation strut 327 movable in the Z-axis direction vertical to the moving direction of the second movable carriage 325. An arm 329 extending in the Y-axis direction is attached to the upper portion of the elevation strut 327 and a workpiece damper 331 which clamps the workpiece W is provided on the tip end portion of this arm 329.

Figure 23:
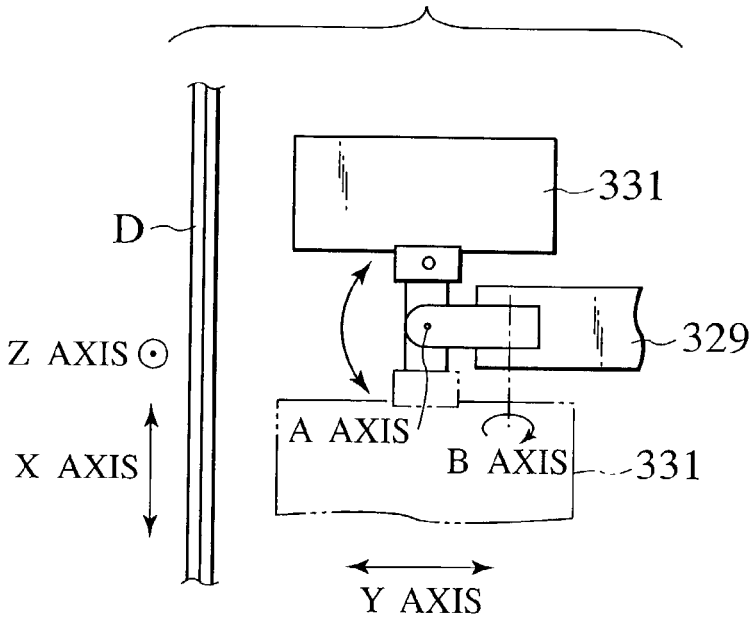
FIG. 23 is a plan view of a workpiece clamper.
Figure 24:
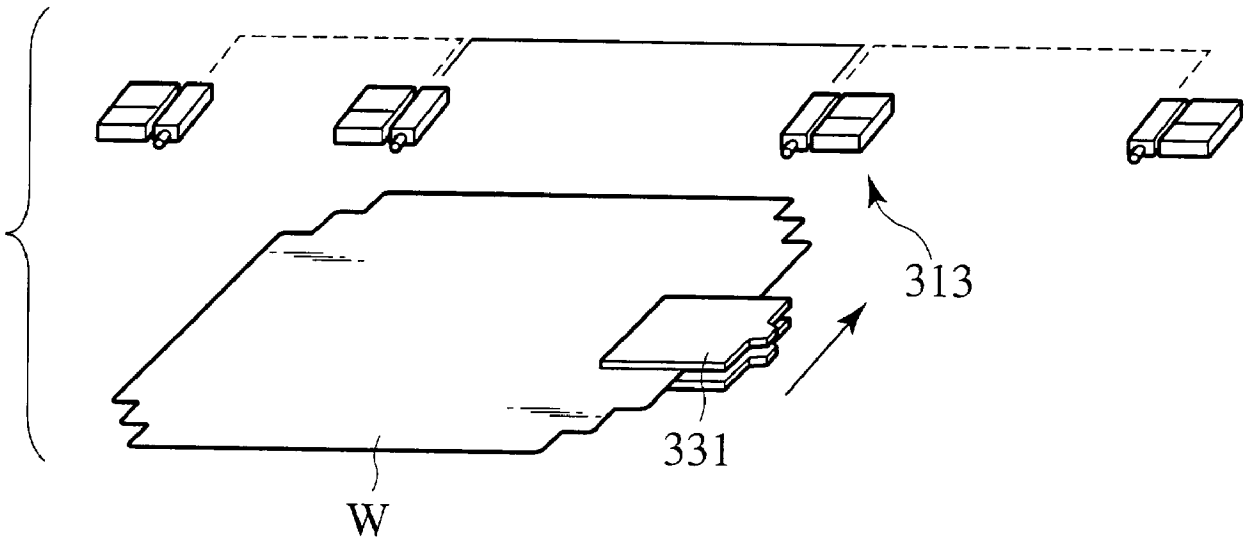
FIG. 24 is a perspective view showing a state in which the workpiece is abutted on a back gauge unit.

Referring also to FIG. 23, the workpiece damper 331 is provided to rotate about a B axis parallel to the X axis in the vertical direction and to turn about the A axis vertical to the B axis.

With the above-stated configuration, in the robot 303, the first moving carriage 321 is moved and positioned in the X-axis direction along the base plate 319, the second moving carriage 325 is moved and positioned in the Y-axis direction, and the elevation strut 327 is moved and positioned in the Z-axis direction. The workpiece clamper 331 which clamps the workpiece W is turned and positioned about the A axis and the B axis, to abut the workpiece W on the back gauge unit 313 to position and bend the workpiece W.

Referring again to FIGS. 7 and 8 used in the third embodiment, a plurality of displacement gauges 333 which detect the lower end of the workpiece W are provided in the die D in the longitudinal direction of the die D. Each of these displacement gauges 333 is provided with a detection pin 339 which is always urged upward by a spring 335 and protruded vertically movably to the V-groove 337 of the die D, and is provided with a linear scale 341 which detects the upper and lower positions of this detection pin 339.

Accordingly, the workpiece W which is pressed and bent by the punch P presses the detection pin 339 downward, the upper and lower positions of the detection pin 339 at this time are detected by the linear scale 341, and, as shown in FIG. 8, the distance between the upper end portion of the detection pin 339 and the upper surface of the die D is obtained as an inter-blade distance ST.

Figure 25:
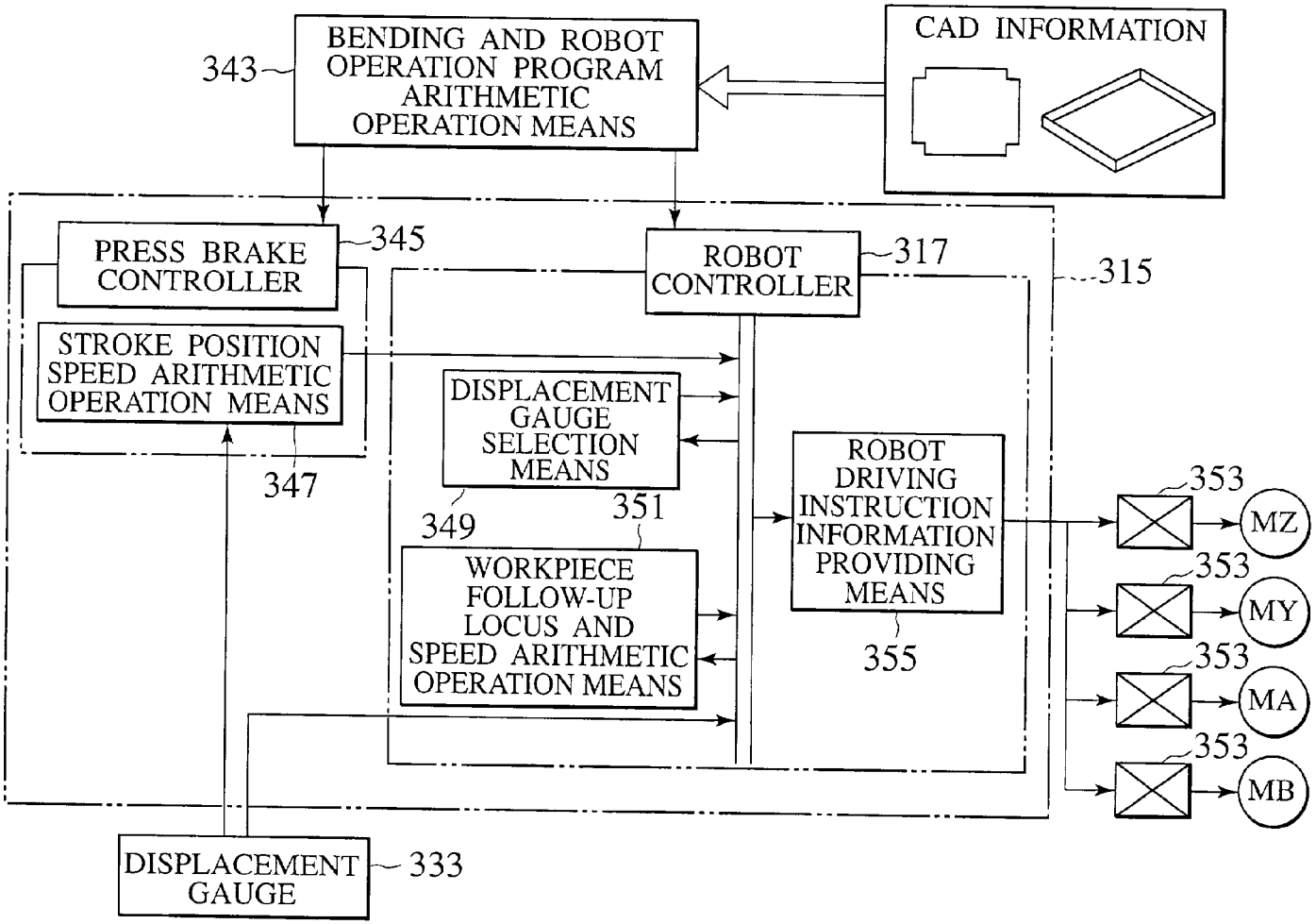
FIG. 25 is a block diagram showing the configuration of a controller.

Referring to FIG. 25, a bending and robot operation program arithmetic operation means 343 which creates a program for the bending operation of the press brake 301 based on CAD information and creates a program for the workpiece support operation of the robot 3, is connected to the controller 315. In addition, the controller 315 is provided with a press brake controller 345 which controls the press brake 301 and a robot controller 317 which controls the robot 303, and controls the press brake 301 and the robot 303 in accordance with the programs created by the bending and robot operation program arithmetic operation means 343.

Displacement gauges 333 are connected to the press brake controller 345 and the controller 345 includes a stroke position and speed arithmetic operation means 347 which calculates the upper and lower positions (ST1, ST2 and ST3 in FIG. 26) of the punch P and the moving speed thereof from signals from the displacement gauges 333. The bending speed of the workpiece W is calculated from the relative position and speed of the punch P calculated by the stroke position and speed arithmetic operation means 347 and transmitted to the robot controller 317.

Figure 26:
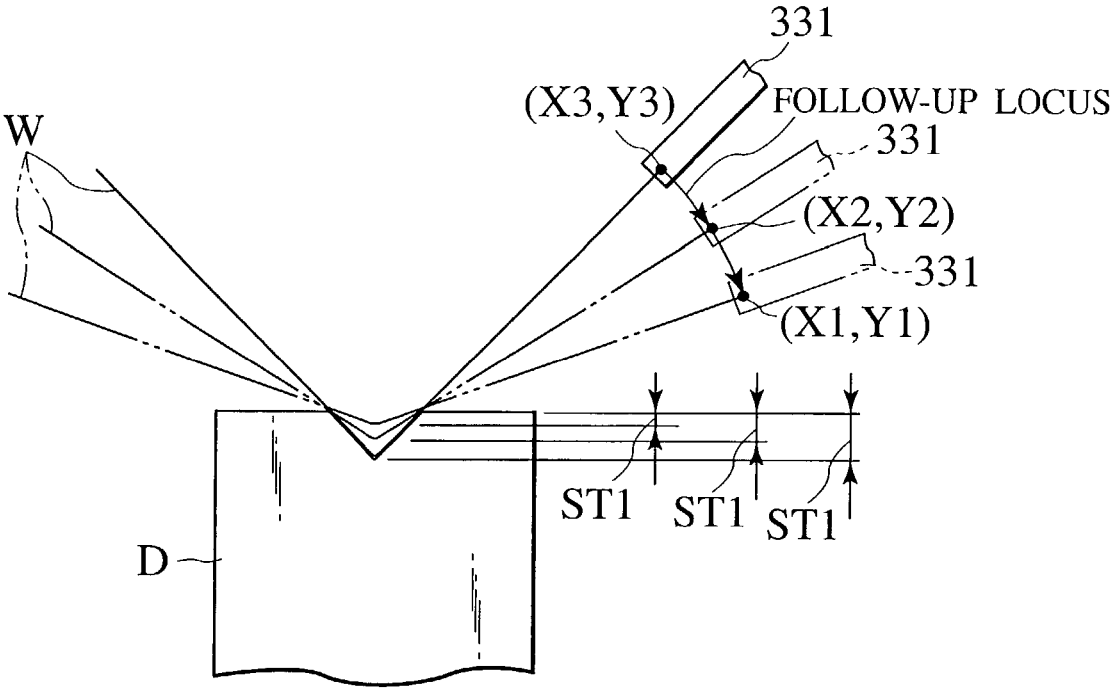
FIG. 26 is an explanatory view showing the follow-up locus of a workpiece clamper following the spring of the workpiece.

Furthermore, the controller 317 includes a displacement gauge selection means 349 which selects the displacement gauge 333 closest to the workpiece clamper 331 connected either through the press brake controller 345 or directly to the robot controller 317, a follow-up locus and speed arithmetic operation means 351 which receives signals for the relative positions, bending speed and the like of the punch P calculated by the stroke position and speed arithmetic operation means 347, which calculates the follow-up locus (X1, Y1), (X2, Y2) or (X3, Y3) of the workpiece damper 331 as shown in FIG. 26 and the follow-up speed thereof, and a robot driving instruction information providing means 355 which distributes an instruction pulse to the Z axis, Y axis, A axis and B axis and instructs axis motors MZ, MY and MA and MB which serve as shaft driving means to control the motors MZ, MY, MA and MB so that the workpiece clamper 331 moves at a follow-up speed along the follow-up locus.

Figure 27:
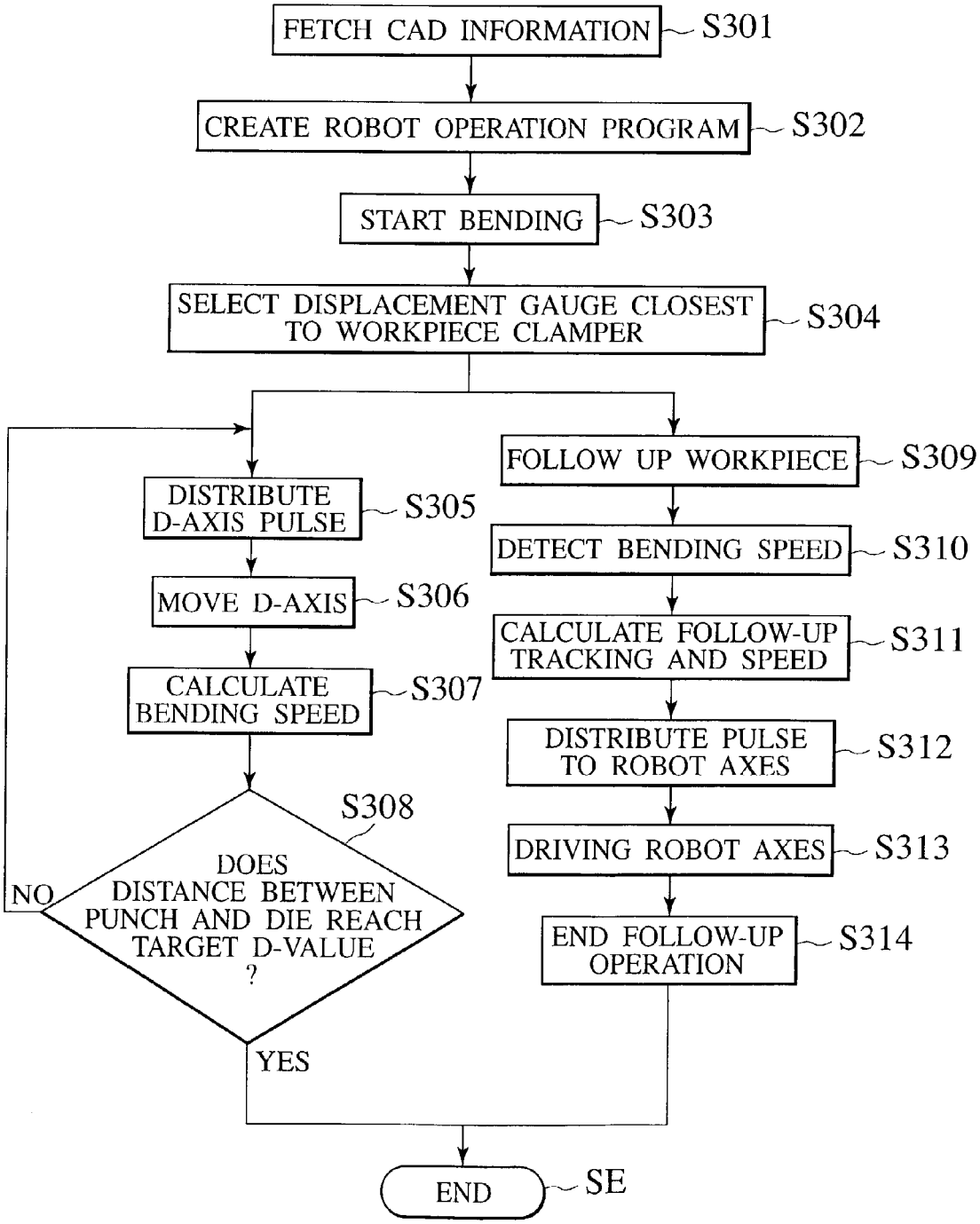
FIG. 27 is a flow chart showing a bending method according to the present invention.

Next, a bending method according to the present invention will be described with reference to FIG. 27.

Before bending, based on graphic information, such as a development view and a three-dimensional view, from the CAD (in a step S301), the robot operation program including a workpiece bending order, the determination of a die, the workpiece clamper position and workpiece installation attitude and the like for the workpiece clamper, is created in advance (in a step S302).

Bending starts (in a step S303), and the displacement gauge 333 closest to the workpiece damper 331 in the X axis direction is selected from among a plurality of displacement gauges 333 which are provided in the longitudinal direction of the die D, by the displacement gauge selection means 349 (in a step S304).

The press brake controller 345 distributes a D-axis pulse to control the left and right vertical cylinders, for example, ascending and descending the lower table 311L (in a step S305), moves the D axis (in a step S306), and allows the stroke position and speed arithmetic operation means 347 to detect a bending speed from the detection pin 339 of the displacement gauge 333 (in a step S307). The press brake controller 345 then determines whether or not the distance between the punch and the die reaches a target value (in a step S308). If the distance does not reach the target value yet, the controller 345 returns to the step S305 and repeats the step S305 and the following. If the distance reaches the target value, the press brake controller 345 ends controlling the press brake 301 (in a step SE).

On the other hand, the robot controller 317 starts following up the workpiece W in accordance with the operation of the press brake 301 (in a step S309), detects a bending speed from the position of the detection pin 339 of the displacement gauge 333 previously selected by the displacement gauge selection means 349 (in a step S310) and allows the follow-up locus and speed arithmetic operation means 351 to calculate the follow-up position of the workpiece damper 331 and thereby calculates the follow-up speed (in a step S311).

To move the workpiece clamper 331 at the follow-up speed from this follow-up position, an instruction pulse is distributed to the robot axes (Z axis, Y axis, A axis and B axis) in response to the instruction of the robot driving instruction information providing means 355 (in a step S312), the motors MZ, MY, MA and MB which serve as respective shaft driving means are actuated to move the robot axes (in a step S313). If the distance between the die and the punch reaches the target value by the processing of the press brake 301, the follow-up of the workpiece W is ended (in a step S314) and the bending is ended (in a step SE).

As a result of the above, since the displacement gauge 33 obtains the bending speed, spring position and spring speed and the like of the workpiece W, it is possible to more accurately obtain the follow-up locus of the workpiece damper 331 based on the actual behavior of the workpiece W. Further, since the workpiece clamper 331 can follow up the workpiece W in accordance with the actual bending speed of the workpiece W, it is possible to prevent the buckling of the workpiece W.

Moreover, since the workpiece W follow-up speed is obtained based on descending speed and speed information from the displacement gauge 333 closest to the workpiece clamper 331 during offset bending, it is possible to highly accurately obtain the follow-up position and follow-up speed.

It is noted that the present invention is not limited to the embodiments of the invention stated so far but can be carried out in the other modes by making appropriate changes to the invention. Namely, in the above-stated embodiments, the press brake 301 having the lower table 311L ascending and descending has been described. However, a press brake of such a type as to ascend and descend the upper table 311U is also available exactly in the same manner.

What is claimed is:

1. A bending method, comprising:

driving a punch to approach and separate from a die using at least two driving shafts;

directly detecting vertical movement of a workpiece following bending using a plurality of position detectors provided along an interior of a V-groove of the die; and obtaining bending speeds of the workpiece at positions of the position detectors from the vertical movement, and controlling the driving shafts so as to make the workpiece bending speeds at the positions of the position detectors equal to one another.

2. The bending method according to claim 1, wherein the driving shafts comprise a left vertical cylinder, a right vertical cylinder and a crowning cylinder provided in a central portion of a lower table.

3. The bending method according to claim 1, wherein, when the workpiece bending speeds detected by the position detectors differ from each other, the driving shafts are controlled to obtain a workpiece bending speed that is an average of the workpiece bending speeds at the positions of the position detectors.

4. The bending method according to claim 2, wherein, when the workpiece bending speeds detected by position detectors for the left vertical cylinder and right vertical cylinder are equal but the workpiece bending speed detected by a position detector for the central portion is different, the crowning cylinder is controlled to change a pressure of the crowning cylinder so that the workpiece bending speed detected by the position detector for the central portion becomes equal to the workpiece bending speeds detected by the position detectors for the left vertical cylinder and the right vertical cylinder.

5. A bending device comprising:

at least two driving shafts;

a punch and a die driven to relatively approach and separate from each other by the at least two driving shafts so as to bend a workpiece;

a plurality of position detectors provided along an interior of a V-groove of the die;

a workpiece bending speed calculator that calculates workpiece bending speeds from vertical movement of the workpiece detected by the position detectors;

a uniform speed calculator that calculates a uniform speed from the workpiece bending speeds at positions of the position detectors; and a driving shaft controller that controls the respective driving shafts so that the workpiece bending speeds at the positions of the position detectors become the uniform speed calculated by the uniform speed calculator.

6. The bending device according to claim 5, further comprising:

a lower table that includes an upper end portion to which the die is attached, wherein said driving shafts comprise a left vertical cylinder, a right vertical cylinder and a crowning cylinder provided at a central portion of the lower table.

7. The bending device according to claim 5, wherein, when the workpiece bending speeds calculated by the workpiece bending speed calculator differ from each other, the uniform speed calculator calculates an average of the workpiece bending speeds as the uniform speed, whereby the driving shaft instructor controls the driving shafts to obtain the uniform speed.

8. The bending device according to claim 6, wherein, when the workpiece bending speeds detected by position detectors for the left vertical cylinder and right vertical cylinder are equal but the workpiece bending speed detected by a position detector for the central portion is different, the uniform speed calculator obtains an average speed of the workpiece bending speeds detected by the position detectors for the left vertical cylinder and right vertical cylinder; and the driving shaft instructor controls the crowning cylinder to change pressure of the crowning cylinder so that the workpiece bending speed for the central portion becomes equal to the average speed obtained by the uniform speed calculator for the left vertical cylinder and right vertical cylinder.

* * * * *